US006113520A

United States Patent [19]

Greiner

[11] Patent Number: 6,113,520

[45] Date of Patent: Sep. 5, 2000

[54] COMBINATION JUMP ROPE AND SIDEWALK CHALK HOLDER TOY

[75] Inventor: Marcia Greiner, Northbrook, Ill.

[73] Assignee: Pumpkin, Ltd., Denver, Colo.

[21] Appl. No.: 09/340,554

[22] Filed: Jun. 28, 1999

[51] Int. Cl.[7] ..... A63B 5/20

[52] U.S. Cl. ..... 482/82; 401/6; 401/8

[58] Field of Search ..... 401/6, 8, 49, 67, 401/88, 131; 482/82, 106–108

[56] References Cited

U.S. PATENT DOCUMENTS

| | | | |
|---|---|---|---|
| 264,593 | 9/1882 | Wright | 401/88 |
| D. 364,422 | 11/1995 | Diresta | D19/36 |
| D. 372,049 | 7/1996 | Anderson | D19/55 |
| 849,494 | 4/1907 | Owen | 401/88 |
| 4,801,137 | 1/1989 | Douglas | 482/82 |
| 5,058,883 | 10/1991 | Dybvik | 482/82 |
| 5,102,381 | 4/1992 | Danielak | 482/82 |

*Primary Examiner*—Jerome Donnelly
*Attorney, Agent, or Firm*—John R. Ley

[57] ABSTRACT

An elongated flexible rope has a pair of handles connected at opposite ends of the rope, and at least one of the handles retains a stick of sidewalk chalk. The handle is a chalk holder, and the resulting combination facilitates new forms of games and play involving jumping rope and marking with the chalk.

14 Claims, 4 Drawing Sheets

COMBINATION JUMP ROPE AND SIDEWALK CHALK HOLDER TOY

The present invention relates to toys. More particularly, the present invention relates to a toy that functions both as a jump rope and as a sidewalk chalk holder.

BACKGROUND OF THE INVENTION

Jump ropes have been used by children for generations. Jump ropes ordinarily consist of a flexible cord or rope with a handle at each end. Typically, the handles of the jump rope are used to twirl the rope while one or more children jump over the twirling rope. Through the years numerous games and activities have been conceived and improvised using a basic jump rope.

Another common children's toy is sidewalk chalk. Sidewalk chalk typically consists of a stick or cylinder of material which can mark concrete or asphalt. Sidewalk chalk is often used to draw pictures on asphalt or concrete. A sidewalk chalk holder typically comprises a plastic case which covers and protects the chalk on all sides except the drawing tip.

SUMMARY OF THE INVENTION

The present invention relates to a new toy which integrates both a jump rope and a sidewalk chalk holder into a single toy. This new jump rope and sidewalk chalk holder toy provides the functionality and use of these previously separate toys in a single unit, thereby facilitating and encouraging new games and play.

In a preferred embodiment of the present invention, a flexible rope or cord has a pair of handles mounted at each end. Each of the handles comprises a body which is attached on one end to the rope, and which has a aperture or opening on the opposite end for inserting and retaining a stick of chalk. Preferably the chalk is in the form of a slightly tapered cylinder which can be easily and snugly inserted into the aperture of the handle.

A more complete appreciation of the present invention and its scope can be obtained by reference to the following detailed description of presently preferred embodiments of the invention taken in connection with the accompanying drawings, which are briefly summarized below, and by reference to the appended claims.

DETAILED DESCRIPTION

Figure 1:
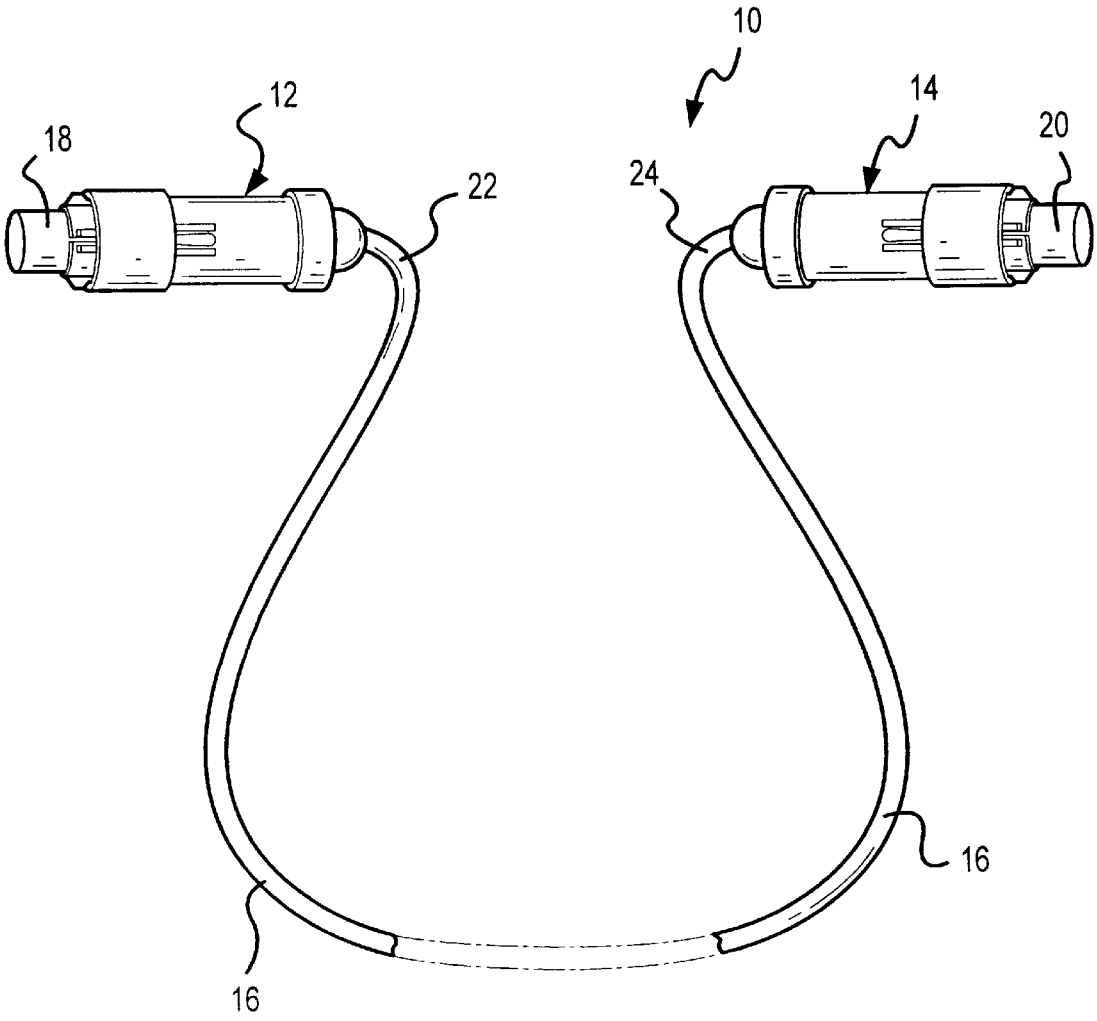
FIG. 1 is a perspective view of a combination jump rope/sidewalk chalk holder toy which embodies the present invention.

A combination jump rope and sidewalk chalk holder toy 10 which embodies the present invention is generally illustrated in FIG. 1. The toy 10 comprises two identical handles 12 and 14 and an elongated cord or rope 16 which extends between the handles 12 and 14. The toy 10 can be used as a conventional jump rope where, for example, the handles 12 and 14 are used to twirl the rope 16 while one or more children jump over the twirling rope 16. The handles 12 and 14 of the toy 10 can also be used as conventional sidewalk chalk holders for holding sticks of chalk 18 and 20, respectively, which are used for drawing on asphalt or concrete. The flexible rope 16 does not restrict the movement of the handles 12 and 14 when drawing with the sticks of chalk 18 and 20. Combining a jump rope and sidewalk chalk holder in this way provides the features of two separate toys in one light and portable toy 10 which facilitates the use and interaction of both individual toys.

The rope 16 which extends between the two handles 12 and 14 may be constructed of any number of natural or synthetic substances which provide sufficient textile strength, flexibility, and durability to function as a jump rope. The rope 16 will preferably be between five and seven feet in length, however, a variety of rope lengths outside of this range may be employed. The length of the rope 16 extends between its opposite ends 22 and 24, located at the handles 12 and 14, respectively.

Figure 2:
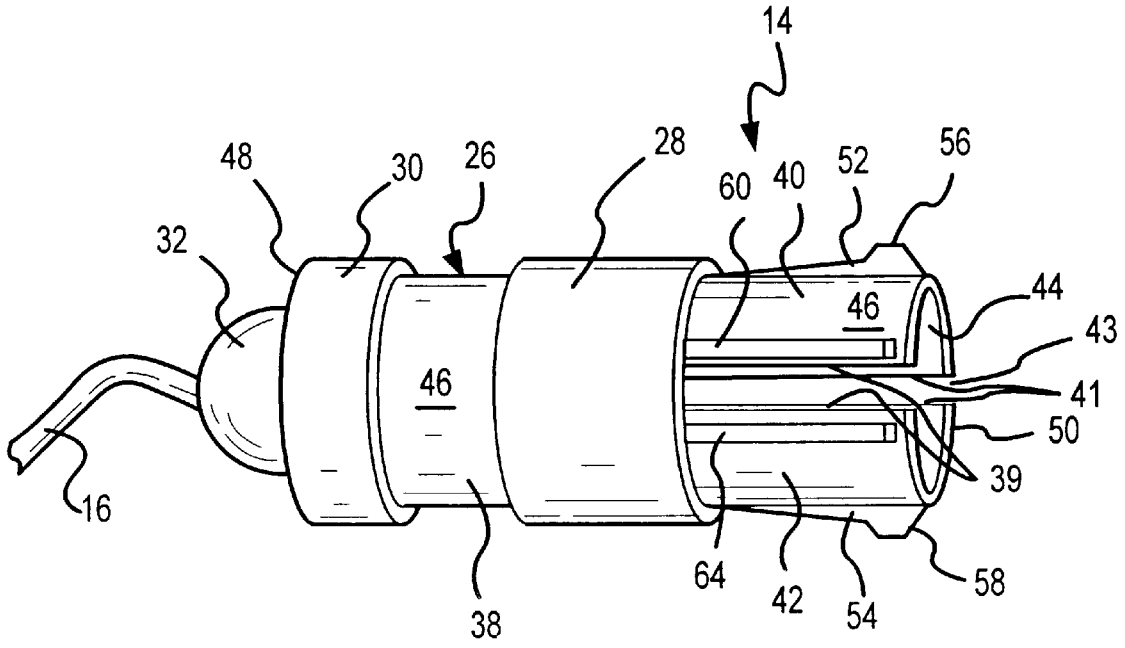
FIG. 2 is an enlarged perspective view of the right handle of the combination jump rope and sidewalk chalk holder toy shown in FIG. 1.
Figure 3:
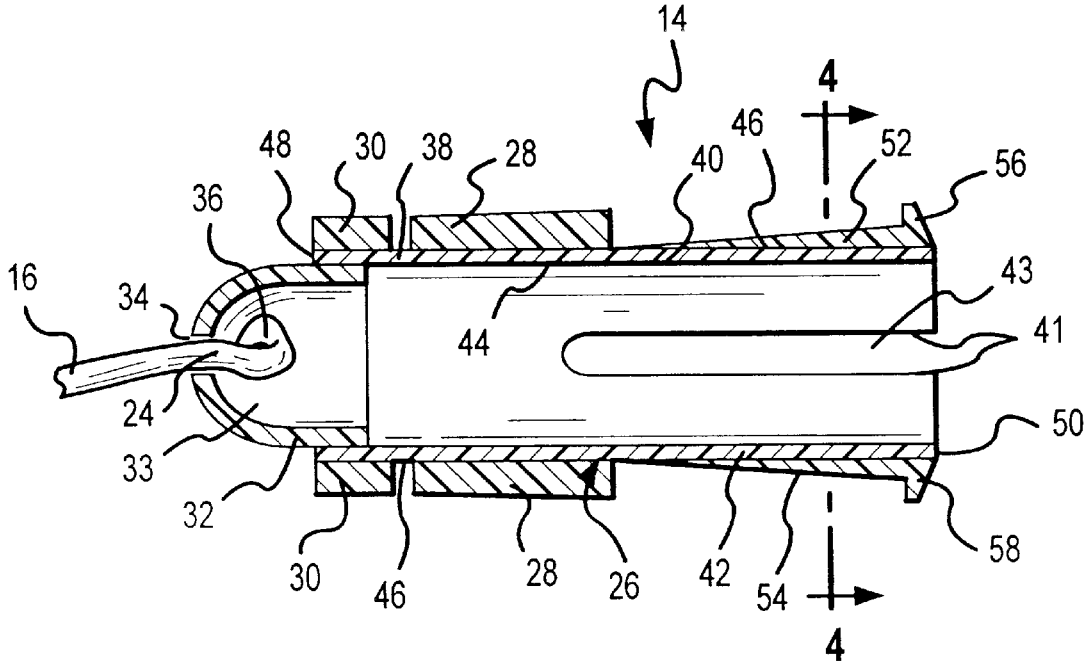
FIG. 3 is a vertical sectional view of the handle shown in FIG. 2.

Each of the handles 12 and 14 is preferably identical. As shown in FIGS. 2 and 3, the handle 14 preferably comprises a tubular main body 26, an annular clamping sleeve 28, an annular stop ring 30, and a substantially hemispherical end piece 32. As shown in FIG. 3, a hole 34, located in the center of the end piece 32, allows the passage of the end 24 of the rope 16 into the interior 33 of the end piece 32 and the hollow main body 26 of the handle 14. A sufficiently large knot 36 or fastener is fixed on the end 24 of the rope 16 to prevent the end 24 of the rope 16 from exiting the handle 14 through the hole 34, thereby securing the end 24 of the rope 16 in the handle 14.

Figure 4:
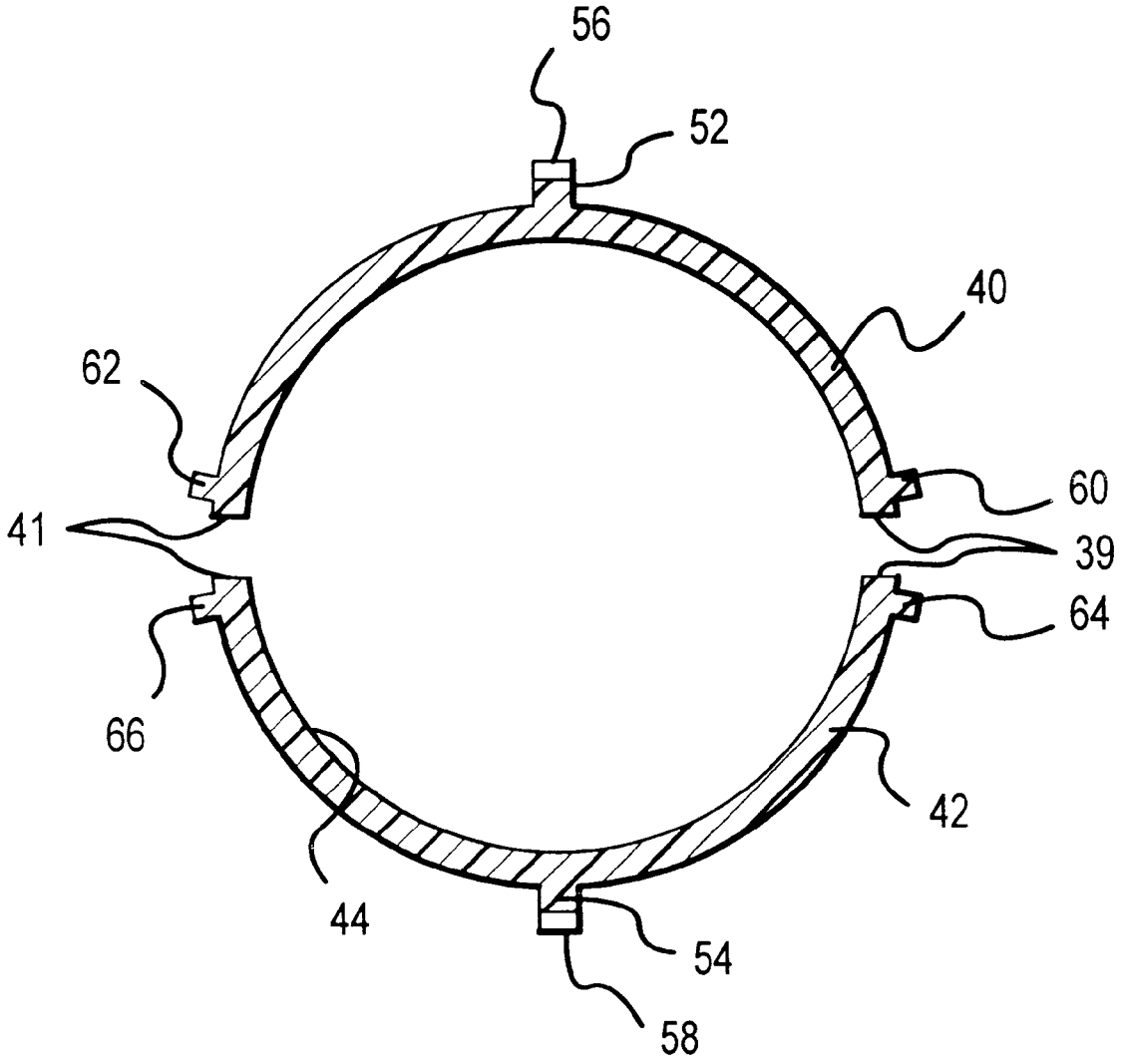
FIG. 4 is a cross sectional view of the handle taken in the plane of line 4—4 in FIG. 3.
Figure 5:
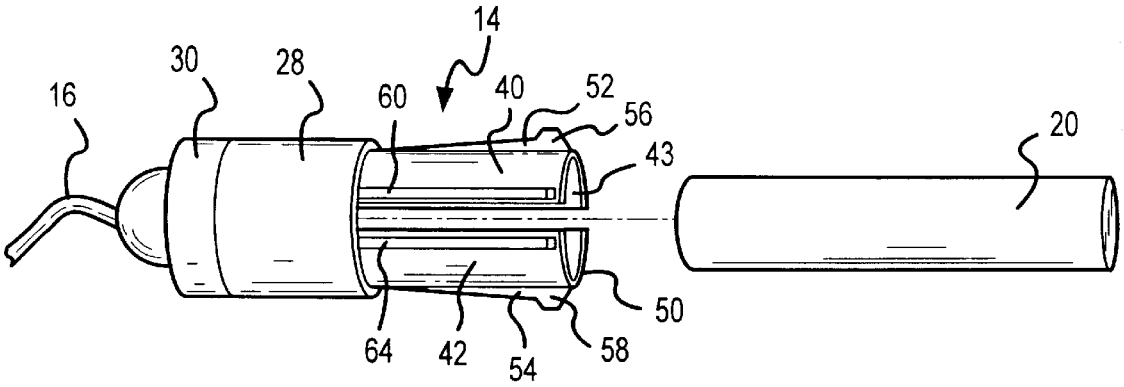
FIG. 5 is a perspective view of the handle shown in FIG. 2 in an open configuration set to receive a stick of chalk which is shown in an exploded relationship to the handle.
Figure 6:
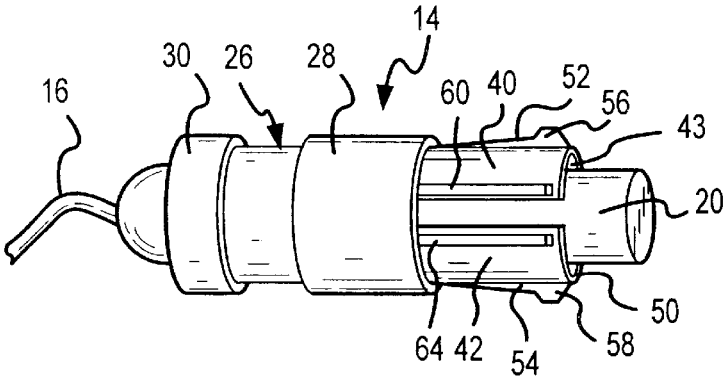
FIG. 6 is a perspective view of the handle shown in FIG. 5 in an intermediate configuration with the chalk inserted in the handle.

The main body 26 comprises a cylindrical portion 38 and a pair of tines 40 and 42 extending integrally from the cylindrical portion 38. The tines 40 and 42 are semicircular in cross-sectional shape as shown in FIG. 4. A pair of diametrically opposed slots 39 and 41 extend along a portion of the main body 26, as shown in FIGS. 2, 3, and 4. The slots 39 and 41 divide the main body 26 into the tines 40 and 42. The cylindrical portion 38 together with the tines 40 and 42 form the elongated, hollow, substantially tubular aperture 43 or opening of the main body 26 into which the stick of chalk 20 is received (FIGS. 5 and 6). The main body 26 has an inner surface 44 at the aperture 43, an outer surface 46, an end 48 that is closed by the end piece 32, and an opposite open end 50 that circumscribes the aperture 43.

Extending outward from the outer surface 46 of the main body 26 and centrally positioned along the length of the tines 40 and 42 are two inclined ridges 52 and 54, respectively. The inclined ridges 52 and 54 preferably begin at about the locations where the tines 40 and 42 join the cylindrical portion 38 of the main body 26. Each ridge 52 and 54 gradually increases in height relative to the outer surface 46 until it reaches the open end 50 of the main body 26. Located at the open end 50 of the main body 26 on each ridge 52 and 54 is a raised shoulder 56 and 58, respectively.

Also extending outward from the outer surface 46 of the main body 26 parallel to the length of the tines 40 and 42 are four spacing bars 60, 62, 64, and 66, as shown in FIG. 4. Two spacing bars are positioned on each tine, one on each opposite side of and running parallel with the inclined ridges 52 and 54. The spacing bars 60, 62, 64, and 66 extend from the outer surface 46 of the main body 26 at a uniform height or, preferably, they begin flush with the outer surface 46 of the main body 26 and gradually increase in height until they reach the open end 50 of the main body 26, in a manner similar to the inclination of the ridges 52 and 54.

The entire main body 26, including the cylindrical portion 38, the tines 40 and 42, the inclined ridges 52 and 54, and the spacing bars 60, 62, 64, and 66, is preferably molded as a single integral plastic or polypropylene unit, although a variety of synthetic or natural materials and fabrication techniques could be employed in constructing the main body 26.

The annular stop ring 30 is positioned coaxially around the closed end 48 of the main body 26 where it is permanently attached to the outer surface 46 of the main body 26, such as with an adhesive or by plastic welding. The clamping sleeve 28 is formed as an integral cylinder which surrounds the main body 26. The clamping sleeve 28 moves axially along the outer surface 46 of the main body 26.

The annular clamping sleeve 28 is initially positioned on the main body 26 by pressing the tines 40 and 42 together at the outer ends of the slots 39 and 41 until the distance between the shoulders 56 and 58 is less than the inside diameter of the clamping sleeve 28. The clamping sleeve 28 is then slid axially over the shoulders 56 and 58. The tines are then released and the clamping sleeve 28 is free to slide axially along the outer surface 46 of the main body 26 between the stop ring 30 and the shoulders 56 and 58.

The end piece 32 is positioned coaxially within the closed end 48 of the main body 26 where it is permanently attached to the inner surface 44 of the main body 26, such as with an adhesive or by plastic welding. While the stop ring 30 and the end piece 32 have been described as being permanently attached to the main body 26, the main body 26, stop ring 30, and end piece 32 could be molded together into one integral unit.

Figure 7:
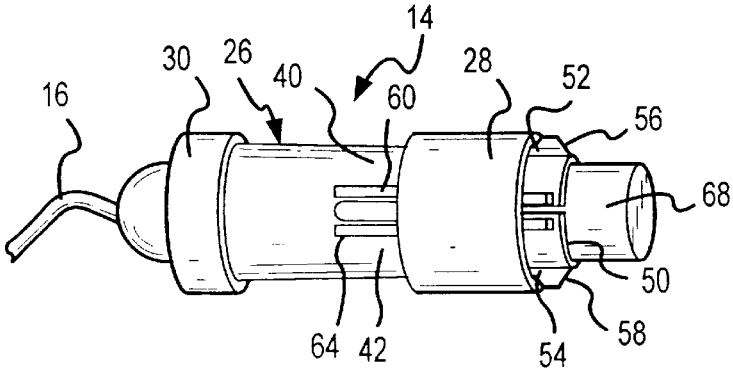
FIG. 7 is a perspective view of the handle shown in FIG. 6 with the handle in a closed configuration.

As shown in FIGS. 5, 6, and 7, a stick of chalk 20 is inserted into and held within the handle 14 of the toy 10. Preferably the chalk 20 is in the form of a slightly tapered cylinder as shown in FIG. 5. The chalk 20 may consist of any material or combination of materials which are typically used in the construction of chalk 20. The chalk 20 may come in a variety of colors and is usually larger than conventional blackboard chalk.

Before inserting the chalk 20 into the handle 14, the clamping sleeve 28 is slid back toward the closed end 48 of the main body 26 until it abuts the stop ring 30, thus allowing the tines 40 and 42 to become fully separated and placing the handle 14 in its open configuration, as shown in FIG. 5. Next, the chalk 20 is inserted between the tines 40 and 42 and into the main body 26 as shown in FIG. 6. The clamping sleeve 28 is then slid forward along the main body 26 toward the shoulders 56 and 58 located at the open end 50 of the main body 26. As the clamping sleeve 28 moves away from the stop ring 30 it engages the inclined ridges 52 and 54, as shown in FIG. 5, thus forcing the tines 40 and 42 towards one another and applying frictional force on the chalk 20 to hold the chalk 20 in the handle 14. When the clamping sleeve 28 abuts the shoulders 56 and 58, as shown in FIG. 7, the tines 40 and 42 are completely closed around the chalk 20 and the handle 14 is in its closed configuration. The spacing bars 60, 62, 64, and 66 function to evenly guide and position the clamping sleeve 28 on the main body 26 as it moves between the stop ring 30 and the shoulders 56 and 58, and to assist in preventing the clamping sleeve 28 from binding on the main body 26 due to misalignment.

When a new stick of chalk 20 is placed in the handle 14 in the manner described above, an exposed portion 68 (FIG. 7) of the chalk 20 will extend beyond the open end 50 of the main body 26 permitting the exposed portion 68 of the chalk 20 to be used to write or draw on the sidewalk or pavement. As the exposed portion 68 of the chalk 20 wears down, the chalk 20 may be further extended from the handle 14. The clamping sleeve 28 is slid back along the main body 26 until it abuts the stop ring 30, the chalk 20 is repositioned in the handle 14 to more fully expose a larger exposed portion 68 of the chalk 20, and the clamping sleeve 28 is slid forward to abut the shoulders 56 and 58 and hold the chalk 20 in its new position.

The combination jump rope and sidewalk chalk holder toy 10 can be used both as a conventional jump rope or as a convenient holder for sidewalk chalk. Toy 10 may be used in a way that combines jumping rope with the use of sidewalk chalk 20. For example, jumping games may be played which require a pattern or playing area to be drawn on the ground, over or through which one jumps using the rope. In jump rope games which require scoring, scoring may be kept by marking the scores on the sidewalk with the sidewalk chalk 20 held in the handle 14. The rope can also be positioned as a border around objects drawn on the sidewalk in non-jumping games, for example. Accurate circles or arcs may be made on the sidewalk or pavement by firmly holding one end of the rope 16 as a center point, pulling the rope 16 taut, and circumscribing a line with the chalk held in the handle 14. Combining a jump rope and sidewalk chalk holder in this way provides all of these features in one light and portable toy and also facilitates and encourages new games and play.

Presently preferred embodiments of the invention and its improvements have been described with a degree of particularity. This description has been made by way of preferred example. It should be understood that the scope of the present invention is defined by the following claims, and should not be unnecessarily limited by the detailed description of the preferred embodiment set forth above.

The invention claimed is:

1. A combination jump rope and sidewalk chalk holder toy comprising an elongated flexible rope and a pair of handles each respectively connected to an opposite end of the rope, at least one of the handles having a retaining aperture for holding a stick of chalk partially within and partially outside of the retaining aperture, and a stick of chalk retained partially within the retaining aperture and extending partially outside of the retaining aperture and exteriorly of the handle.

2. A combination jump rope and sidewalk chalk holder toy as defined in claim 1 wherein the one handle includes a structure movable between two positions, the structure holding the chalk partially within and partially outside of the retaining aperture in one position and releasing the chalk from the retaining aperture in the other position.

3. A combination jump rope and sidewalk chalk holder toy comprising an elongated flexible rope and a pair of handles each respectively connected to an opposite end of the rope at least one of the handles having a retaining aperture for a stick of chalk, wherein the one handle comprises:

a cylindrical portion extending along a longitudinal axis, a plurality of tines integral with and extending from the cylindrical portion in parallel relation to the longitudinal axis, the cylindrical portion and the tines defining the aperture into which the stick of chalk can be inserted and retained.

4. A combination jump rope and sidewalk chalk holder toy as defined in claim 3, wherein the one handle further comprises:

an end piece connected to and substantially covering an end of the cylindrical portion opposite of the tines, the end piece retaining an end of the rope.

5. A combination jump rope and sidewalk chalk holder toy as defined in claim 4, wherein the one handle further comprises:

an inclined ridge positioned on an exterior of and running axially along one tine; and an annular clamping sleeve positioned coaxially around and axially movable along the cylindrical portion and the tines, the clamping sleeve contacting the inclined ridge to force the tine toward the axis and against the chalk.

6. A combination jump rope and sidewalk chalk holder toy as defined in claim 5 wherein the one handle further comprises:

an annular stop ring permanently positioned coaxially around the cylindrical portion at the end piece, the stop ring preventing the clamping sleeve from sliding past the end of the cylindrical portion adjacent the end piece.

7. A combination jump rope and sidewalk chalk holder toy as defined in claim 6 wherein the one handle further comprises:

a shoulder protruding outward from one inclined ridge at the end of the tine opposite from the cylindrical portion, the shoulder preventing the clamping sleeve from sliding over the end of the tine opposite from the cylindrical portion.

8. A combination jump rope and sidewalk chalk holder toy as defined in claim 4 wherein the end piece further includes a hole formed therethrough and through which an end of the rope is inserted.

9. A combination jump rope and sidewalk chalk holder toy as defined in claim 8 further comprises:

a fastener connected to the end of the rope within an interior of the end piece to prevent withdrawal of the end of the rope from the end piece.

10. A combination jump rope and sidewalk chalk holder toy as defined in claim 9 wherein the fastener is a knot in the end of the rope.

11. A combination jump rope and sidewalk chalk holder toy as defined in claim 2, wherein the one handle further comprises:

an end piece connected to the handle, the end piece retaining an end of the rope.

12. A combination jump rope and sidewalk chalk holder toy as defined in claim 11 wherein the end piece further includes a hole formed therethrough and through which an end of the rope is inserted.

13. A combination jump rope and sidewalk chalk holder toy as defined in claim 12 further comprising:

a fastener connected to the end of the rope within an interior of the end piece to prevent withdrawal of the end of the rope from the end piece.

14. A combination jump rope and sidewalk chalk holder toy as defined in claim 13 wherein the fastener is a knot in the end of the rope.

* * * * *